US005984008A

United States Patent [19]

Lang et al.

[11] Patent Number: 5,984,008

[45] Date of Patent: Nov. 16, 1999

[54] INSTALLABLE LOAD SHOULDER FOR USE IN A WELLHEAD TO SUPPORT A TUBING HANGER

[75] Inventors: Heinrich H. Lang, The Woodlands; F. Jeffrey Lane, Houston, both of Tex.

[73] Assignee: ERC Industries, Inc., Houston, Tex.

[21] Appl. No.: 08/951,653

[22] Filed: Oct. 16, 1997

[51] Int. Cl.[6] ..... E21B 43/00

[52] U.S. Cl. ..... 166/208; 285/123.4; 285/321

[58] Field of Search ..... 285/123.4, 321, 285/305; 166/208, 89.3, 75.14

[56] References Cited

U.S. PATENT DOCUMENTS

| | | | |
|---|---|---|---|
| 3,341,227 | 9/1967 | Pierce, Jr. | 285/39 |
| 3,893,717 | 7/1975 | Nelson | 285/3 |
| 3,918,747 | 11/1975 | Putch | 285/4 |
| 4,167,970 | 9/1979 | Cowan | 166/208 |
| 4,515,400 | 5/1985 | Smith et al. | 385/141 |
| 4,534,583 | 8/1985 | Milberger et al. | 285/24 |
| 4,751,968 | 6/1988 | Ames et al. | 166/368 |
| 4,770,249 | 9/1988 | Courtney | 166/379 |
| 4,903,992 | 2/1990 | Jennings et al. | 285/24 |
| 5,026,097 | 6/1991 | Reimert | 285/321 |
| 5,060,985 | 10/1991 | Seaton | 285/141 |
| 5,209,521 | 5/1993 | Osborne | 285/3 |
| 5,259,459 | 11/1993 | Valka | 166/345 |
| 5,327,965 | 7/1994 | Stephen et al. | 166/208 |

*Primary Examiner*—William Neuder
*Attorney, Agent, or Firm*—Head, Johnson & Kachigian

[57] ABSTRACT

An installable load shoulder is used with a wellhead to support a tubing hanger by which tubing is suspended in a well bore, "tubing" being inclusive of any tubular product such as a string of tubing or casing as used in drilling and completing oil or gas wells, the wellhead having a vertical opening therethrough and in the wall defining the opening an internal circumferential groove, the groove having an inwardly sloped bottom frusto-conical circumferential surface and the tubing hanger having an external circumferential surface dimensioned to be slidably received in the wellhead vertical opening and having an external circumferential area defined in part by a frusto-conical circumferential surface. The load shoulder is of toroidal shape, has a split therein, has an internal circumferential surface defined in part by an inwardly sloped upper frusto-conical shaped surface and an external circumferential surface defined in part by a lower outwardly sloped frusto-conical shaped surface. A plurality of spaced apart small diameter vertical openings extending through the load shoulder. A slot is provided for each of the openings, the openings and the slots serving to impart flexibility of the load shoulder whereby it can be collapsed to be inserted into the vertical opening in the wellhead after which is expands into the groove in the wellhead to thereafter support the tubing hanger.

3 Claims, 2 Drawing Sheets

INSTALLABLE LOAD SHOULDER FOR USE IN A WELLHEAD TO SUPPORT A TUBING HANGER

REFERENCE TO PENDING APPLICATIONS

This application is not related to any pending applications.

REFERENCE TO MICROFICHE APPENDIX

This application is not referenced in any microfiche appendix.

BACKGROUND OF THE INVENTION

This invention is concerned with a system by which a tubing string is suspendable within a wellhead and is particularly concerned with an improved installable load shoulder by which a tubing hanger is supported in a wellhead. "Tubing" or "tubing string" as used herein is inclusive of any tubular product used in drilling and completing oil or gas wells and is particularly inclusive of casing. A feature of this invention is an improved installable load shoulder that may be removably positioned in a wellhead to support a tubing hanger and which can be thereafter removed.

When a borehole in the earth is completed it is customary to attach to the upper end of the well structure a wellhead which provides the superstructure for supporting smaller diameter tubular strings. As an example, a common expedient is to suspend within a casing string a tubing string that is supported by a wellhead. For this purpose it is traditional to employ a tubing hanger that is secured to a length of tubing and accordingly means must be provided to support the tubing hanger to or within the wellhead.

A common procedure is to provide in the wellhead an internally extending circumferential ledge upon which a tubing hanger can rest. A problem with this arrangement is that the provision of an internally extending ledge within the interior of a wellhead reduces the internal diameter of the wellhead and thereby limits the diameter of drill bits or other tools or implements that may thereafter be inserted through the wellhead. This invention provides a means of supporting a tubing hanger within a wellhead in a manner such that the normal internal diameter of the wellhead is not reduced, that is, where the wellhead has a full internal diameter open while nevertheless providing means for supporting a tubing hanger. For background information regarding wellhead assemblies, and apparatus for suspending tubing within a wellhead, reference may be had to the following previously issued United States patents:

| U.S. PAT. NO. | INVENTOR | TITLE |
|---|---|---|
| 3,341,227 | Pierce Jr. | Casing Hanger |
| 3,893,717 | Nelson | Well Casing Hanger Assembly |
| 3,918,747 | Putch | Well Suspension System |
| 4,167,970 | Cowan | Hanger Apparatus For Suspending Pipes |
| 4,515,400 | Milberger et al | Mudline Casing Hanger Assembly |
| 4,751,968 | Ames et al | Wellhead Stabilizing Member With Deflecting Ribs |
| 4,770,249 | Courtney | Method and Apparatus For Reduction of Well Assembly Time |
| 4,903,992 | Jennings et al | Locking Ring For Oil Well Tool |
| 5,060,985 | Seaton | Location of Tubular Members |
| 5,209,521 | Osborne | Expanding Load Shoulder |

-continued

| U.S. PAT. NO. | INVENTOR | TITLE |
|---|---|---|
| 5,259,459 | Valka | Subsea Wellhead Tieback Connector |
| 5,327,965 | Stephen et al | Wellhead Completion System |

BRIEF SUMMARY OF THE INVENTION

This invention provides a wellhead system and an installable load shoulder for use with a wellhead by which a tubing hanger may be supported.

The invention is in one aspect, a load shoulder in the form of an integral toroidal member that is useable in a wellhead to support a tubing hanger.

The wellhead has a vertical opening through it and in the wall defining the opening, an internal circumferential groove. The groove has a bottom frusto-conical circumferential surface.

A tubing hanger has an external cylindrical surface that is of a diameter slightly less than the internal cylindrical surface of the wellhead so that the tubing hanger can be inserted into and removed from the wellhead. Further, the tubing hanger has adjacent its lower end a reduced diameter portion that includes an outwardly sloped frusto-conical circumferential surface.

The installable load shoulder is in the form of an integral toroidal member having a vertical cylindrical axis. The toroidal member has a split therein providing two opposed ends and has an internal circumferential surface defined in part by an outwardly sloped upper frusto-conical shaped surface and an external surface that has, adjacent its lower end, a lower outwardly sloped frusto-conical shaped surface.

The load shoulder has a plurality of spaced apart small diameter vertical openings through it, each opening having an axis that is parallel to the vertical cylindrical axis. Further, it has a slot therein for each of the openings, each slot extending from an opening to the load shoulder outer circumferential surface. The openings and slots substantially increase the flexibility of the load shoulder without significantly decreasing its load bearing capability.

To use the installable load shoulder it is collapsed in diameter so that the ends are adjacent to each other, the diameter being thereby reduced to that which is less than the internal diameter of the vertical opening through the wellhead. The load shoulder can then be inserted into the wellhead and into the internal groove formed in the wellhead. When the load shoulder enters the internal groove it is free to radially expand outwardly to an increased external diameter, that is, the space between the opposed ends increase. Thereafter the tubing hanger can be positioned within the opening in the wellhead. In its expanded position the frusto-conical surface adjacent the lower end of the load shoulder engages the lower frusto-conical surface of the wellhead circumferential groove. The tubing hanger outwardly sloped external frusto-conical surface engages the load shoulder upper frusto-conical surface. In this way the load shoulder is forced outwardly by the downward force of the tubing hanger to cause the load shoulder outwardly sloped lower frusto-conical surface to securely engage the wellhead inwardly sloped lower frusto-conical surface. With the weight of the tubing hanger on the load shoulder it is locked into position and securely supports the tubing hanger within the wellhead.

To make available the full internal diameter of the wellhead, the tubing hanger is removed after which the toroidal installable load shoulder can be removed by contracting its external diameter, that is, by moving its opposed ends towards each other so that the total external diameter becomes less than the internal diameter of the wellhead opening.

A better understanding of the invention will be obtained from the following description of the preferred embodiments, taken in conjunction with the attached drawings.

DESCRIPTION OF THE DRAWINGS

FIG. 2 is slightly reduced scale compared to FIG. 1 and shows the load shoulder in its expanded condition.

DETAILED DESCRIPTION OF THE PREFERRED EMBODIMENTS

Figure 1:
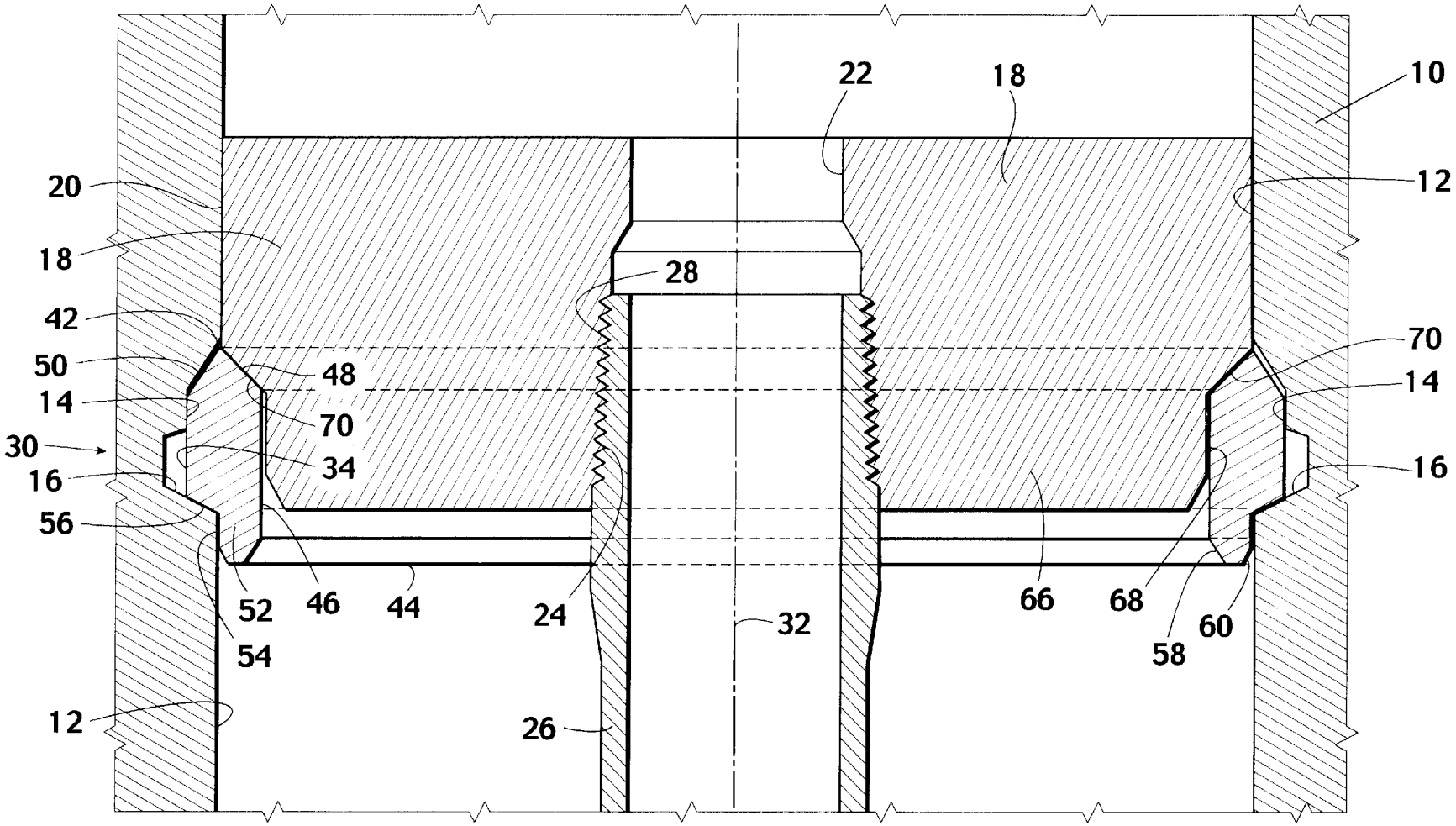
FIG. 1 is an elevational fragmentary view of the interior portion of a wellhead showing a tubing hanger supported within the wellhead and showing an installable load shoulder in the form of an integral toroidal member used to support the tubing hanger. A portion of a length of tubing is shown threadably attached to the tubing hanger. All of the elements are shown in cross-sectional view.

Referring first to FIG. 1, a wellhead is indicated by the numeral 10, the wellhead being shown fragmentary, that is, only a very small portion of the wellhead is illustrated since the typical wellhead has means at the lower end (not shown) by which it is attached to a ground support casing and the upper end (not shown) has means for attachment to ancillary equipment involved in drilling and completing an oil or gas well, such as blowout preventors and so forth. The external configuration of wellhead 10 is also not illustrated since it is not relevant to the invention. The important parts of wellhead 10 that relate to the invention are shown in FIG. 1 and include a vertical opening 12 that extends down through the interior of the wellhead. Opening 12 determines the maximum OD of any object, such as drill bits, casing, tubing hangers, or so forth that can pass downwardly through the wellhead.

The wall of the wellhead has a circumferential internal recess or groove 14. The exact configuration of recess 14 can vary, however, an important aspect is the provision of a lower downwardly and inwardly inclined frusto-conical surface 16. The essence of this invention is an installable load shoulder (which will be described in detail subsequently), providing means of supporting the weight of a tubing hanger so that the weight of the tubular hanger is transmitted by the load shoulder to frusto-conical surface 16.

A tubing hanger is indicated by the numeral 18 and is shown in a highly simplified embodiment sufficient to illustrate the invention. Tubing hanger 18 has an external cylindrical surface 20 of a diameter that is slightly smaller than the internal diameter of vertical opening 12 and wellhead 10 so that the tubing hanger is positionable into and removable from the interior of wellhead 10. A central opening 22 is provided in the tubing hanger 18. In some instances, tubing hanger 18 may include slips (not shown) by which the exterior walls of a string of tubing may be grasped. The design of tubing hanger 18 illustrated in FIG. 1 employs a different method of supporting a string of tubing and that is, the lower portion of central opening 18 is provided with internal threads 24. The upper end portion of a tubing string is indicated by the numeral 26 and has external threads 28 that engage threads 24 in the tubing hanger. By the threadable connection of the upper end portion 26 of a string of tubing to tubing hanger 18, a means is provided for suspending a string of tubing within the well borehole having wellhead 10.

Figure 3:
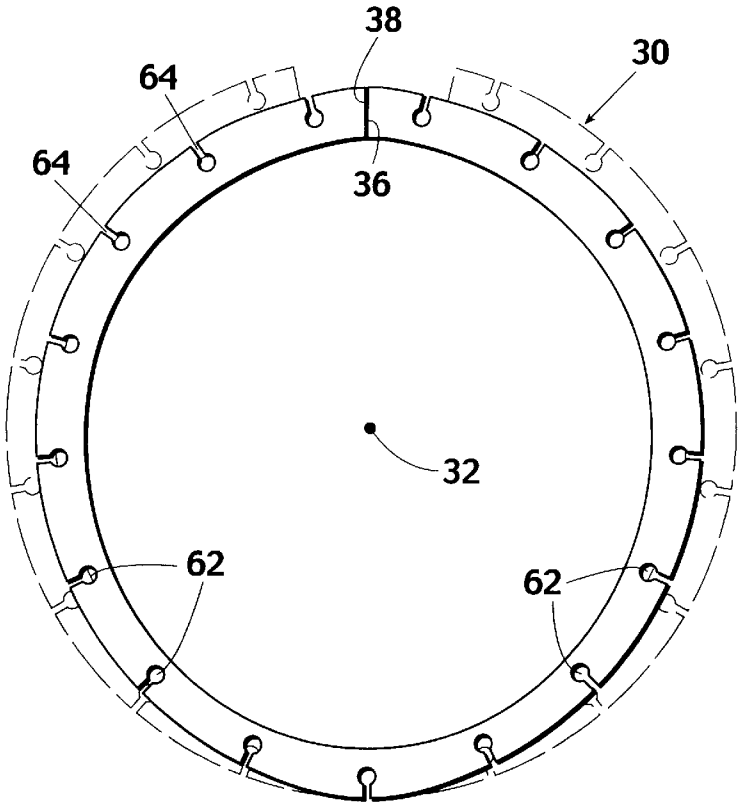
FIG. 3 shows the installable load shoulder in plan view as in FIG. 2 but shows in solid outline the load shoulder in collapsed or reduced diameter condition and in dotted outline in the expanded condition as shown in FIG. 2.
Figure 2:
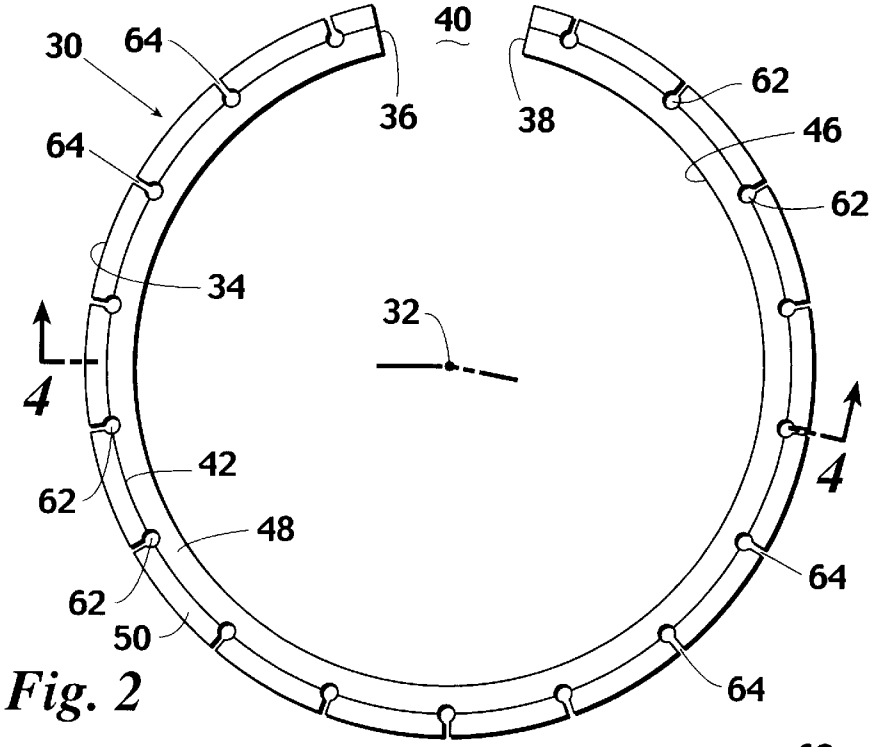
FIG. 2 is a top view of an installable load shoulder.
Figure 4:
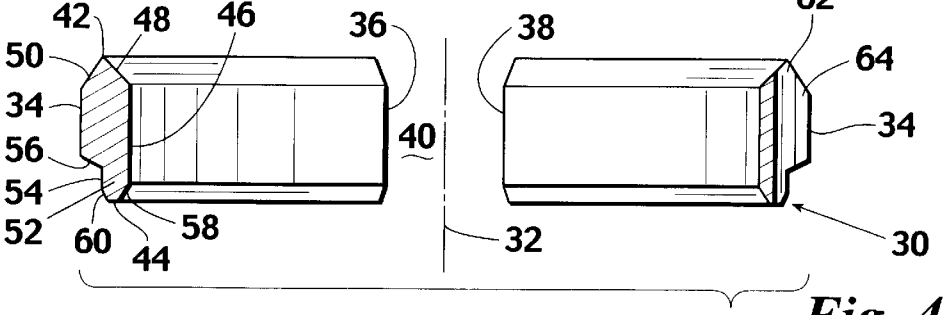
FIG. 4 is a cross-sectional view as taken along the line 4—4 of FIG. 2.

The essence of the invention is a system which provides for removably supporting tubing hanger 18 within wellhead 10. For this purpose, an installable load shoulder generally indicated by the numeral 30 is provided. The load shoulder is in the form of an integral toroidal member having a vertical cylindrical axis 32 as shown both in FIGS. 1 and 2. Installable load shoulder 30 is expandable and contractible in its exterior diameter. When expanded, the external circumferential surface 34 of the load shoulder is greater in diameter than the internal diameter of vertical opening 12 in wellhead 10. As shown in FIGS. 2, 3 and 4, the installable load shoulder is split having opposed ends 36 and 38. Load shoulder 30 is constructed so that the ends 36 and 38 are normally spaced apart providing a gap 40 therebetween as shown in FIGS. 2 and 4. The external diameter of the load shoulder external cylindrical surface 34 can be decreased by compressing the load shoulder so that the opposed ends 36 and 38 touch or at least are in close proximity to each other as shown in solid outline in FIG. 3. When so compressed the external diameter of the load shoulder is reduced to that which is less than the internal diameter of wellhead vertical opening 12. When in the compressed condition as shown in solid outline in FIG. 3, the load shoulder can be positioned within wellhead vertical opening 12 and slid into position to align within internal circumferential groove 14. When in alignment with groove 14, the load shoulder is free to expand to its normal enlarged circumferential dimension as shown in solid outline in FIG. 2 and in dotted outline in FIG. 3. When in its normal, enlarged condition, the load shoulder external surface 34 engages the wall of the wellhead circumferential groove 14 as shown in FIG. 1.

The cross-sectional configuration of the load shoulder, as shown in FIGS. 1 and 4, illustrates that it is an integral toroidal split member having a top edge 42 and a bottom edge 44. The load shoulder has a circumferential cylindrical internal surface 46, the internal surface 46 being cylindrical about axis 32 and a coaxial external cylindrical surface 34.

The upper portion of load shoulder 30 is defined by an outwardly and upwardly sloped frusto-conical surface 48 and an inwardly upwardly sloped frusto-conical surface 50. The juncture of frusto-conical surfaces 48 and 50 form top edge 42.

The lower portion of the load shoulder includes an integral reduced external diameter portion 52 defined in part by an external cylindrical surface 54 of diameter less than the basic external diameter 34. Extending from cylindrical surface 54 to cylindrical surface 34 is an outwardly and upwardly projecting frusto-conical surface 56. Cylindrical surface 54 is in alignment with the load shoulder top edge 42.

A short length outwardly and downwardly extending frusto-conical surface 58 and a similar downwardly and inwardly extending outer frusto-conical surface 60 extend to the load shoulder bottom edge 44. When expanded within circumferential groove 14 formed in wellhead internal surface 12, the load shoulder external surface portions 50, 34 and 56 engage the surfaces forming internal circumferential groove 14 in the wellhead. External surface 54 of the load shoulder contacts a portion of the wellhead vertical opening 12. The most important surface relationships between the load shoulder and the wellhead is the contact of load shoulder frusto-conical surface 56 with wellhead internal groove frusto-conical surface 16. This contact securely supports the load shoulder to the wellhead.

As shown in FIGS. 2, 3 and 4, a plurality of spaced apart openings 62 are drilled in the load shoulder. The axis of each of openings 62 is parallel to the vertical cylindrical axis 32 of the load shoulder. In addition, a slot 64 communicates each of the openings 62 with the load shoulder external circumferential surface 34.

The combination of drilled openings 62 and slots 64 add greatly to the flexibility of the toroidal load shoulder, allowing it to be more easily compressibly collapsed so that the ends 36 and 38 can approach or contact each other as shown in solid outline in FIG. 3 when inserting the load shoulder into opening 12 in wellhead 10.

Referring back to FIG. 1, it can be seen that tubing hanger 26 has an integral lower reduced external diameter portion 66 providing a reduced diameter cylindrical surface 68. The external diameter of cylindrical surface 68 is slightly less than the internal diameter of the load shoulder internal surface 46 when the load shoulder is fully expanded within the wellhead circumferential groove. Connecting the reduced external diameter portion 68 with the full external diameter surface 20 of tubing hanger 18 is an outwardly and upwardly inclined frusto-conical surface 70. This surface rests on load shoulder outwardly and upwardly sloped frusto-conical surface 48 by which the weight of the tubing string 26 secured to tubing hanger 18 is supported. The cylindrical surface 68 of the tubing hanger which matches the load shoulder internal cylindrical surface 46 insures that the load shoulder remains securely positioned within the wellhead internal groove.

When tubing hanger 18 is removed from within wellhead 10 load shoulder 30 can then be collapsed to the solid outline condition shown in FIG. 3 to permit it to be extracted from within the interior of the wellhead. After the load shoulder is removed, the full interior diameter of the wellhead is then available for insertion of tools or other equipment. In this way, which eliminates the employment of a fixed internal load shoulder within the interior of the wellhead, the maximum internal diameter opening of the wellhead is preserved.

The construction of the load shoulder is such as to provide for a high degree of flexibility of the load shoulder to permit it to be collapsed when inserting or removing it from the wellhead but, at the same time, in a way which does not impair its load bearing capabilities.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. An installable load shoulder for use with a wellhead to support a tubing hanger, the wellhead having a vertical opening therethrough defined by an internal wall having an internal circumferential groove therein, and the tubing hanger having an external circumferential surface dimensioned to be slidably received in said wellhead vertical opening, the tubing hanger having provision for supporting a length of tubing, comprising:

an integral toroidal member having a vertical cylindrical axis, having a split therein defining opposed first and second ends having an internal circumferential surface and an external circumferential surface, having a plurality of spaced apart small diameter vertical opening therethrough, each opening having an axis that is parallel to said member vertical cylindrical axis and the member having a slot therein for each said opening, each slot communicating between a said opening and said member external circumferential surface, said openings and said slots serving to impart flexibility to the member, the member being circumferentially collapsible to an outside diameter less than the internal diameter of said wellhead vertical opening whereby the member may be positioned in said wellhead internal circumferential groove, the member expandable in said internal groove, said tubing hanger being positionable within said wellhead vertical opening whereby the tubing hanger engages said member whereby said tubing hanger is supported within said wellhead.

2. An installable load shoulder for use with a wellhead to support a tubing hanger, the wellhead having a vertical opening therethrough defined by an internal wall having an internal circumferential groove therein, the groove having a bottom frusto-conical circumferential surface and the tubing hanger having an external circumferential surface dimensioned to be slidably received in said wellhead vertical opening and having a reduced external circumferential area defined in part by a frusto-conical circumferential surface, the tubing hanger having provision for supporting a length of tubing, comprising:

an integral toroidal member having a vertical cylindrical axis, having a split therein defining opposed first and ends, having an internal circumferential surface defined in part by an inwardly sloped upper frusto-conical shaped surface and, an external circumferential surface defined in part by a lower outwardly sloped frusto-conical shaped surface, having a plurality of spaced apart small diameter vertical openings therethrough, each opening having an axis that is parallel to said member vertical cylindrical axis and having a slot therein for each said opening, each slot communicating between a said opening and said member external circumferential surface, said openings and said slots serving to impart flexibility to the member, the member being circumferentially collapsible to an outside diameter less than the internal diameter of said wellhead vertical opening whereby the member may be positioned in said wellhead internal circumferential groove, the member being expandable in said wellhead internal groove whereby said lower frusto-conical shaped surface of the member engages said wellhead circumferential groove bottom frusto-conical surface, said tubing hanger being positionable within said wellhead vertical opening whereby said tubing hanger frusto-conical circumferential surfaces can engage said member internally sloped upper frusto-conical shaped surface whereby said tubing hanger is supportable within a wellhead by the load shoulder.

3. A system for supporting tubing in a borehole comprising:

a wellhead having a vertical opening therethrough defined by a wall having an internal circumferential groove, the groove having a bottom frusto-conical circumferential surface;

a tubing hanger having an external circumferential surface dimensioned to be slidably received in said wellhead vertical opening and having a reduced external circumferential area defined in part by a frusto-conical circumferential surface, the tubing hanger having provision for supporting a length of tubing; and an integral toroidal load shoulder having a vertical cylindrical axis, having a split therein defining opposed first and second ends, having an internal circumferential surface defined in part by an outwardly sloped upper frusto-conical shaped surface, having an external circumferential surface define in part by a lower outwardly sloped frusto-conical shaped surface, having a plurality of spaced apart small diameter vertical openings therethrough, each opening having an axis that is parallel to said vertical cylindrical axis and having a slot therein for each said opening, each slot communicating between a said opening and said load shoulder external circumferential surface, said openings and said slots serving to impart flexibility to the load shoulder, the load shoulder being circumferentially collapsible to an outside diameter less than the internal diameter of said wellhead vertical opening whereby the load shoulder may be positioned in said wellhead internal circumferential groove, the member expandable in said internal groove whereby said lower frusto-conical shaped surface of the load shoulder engages said wellhead circumferential groove bottom frusto-conical surface, said tubing hanger being positionable within said wellhead vertical opening whereby said tubing hanger frusto-conical circumferential surfaces engages said load shoulder internally sloped upper frusto-conical shaped surface whereby said tubing hanger is supported within said wellhead against downward displacement.

* * * * *